US005352952A

United States Patent [19]

Juengst

[11] Patent Number: 5,352,952

[45] Date of Patent: Oct. 4, 1994

[54] HIGH-PRESSURE DISCHARGE LAMP WITH CERAMIC DISCHARGE VESSEL

[75] Inventor: Stefan Juengst, Zorneding, Fed. Rep. of Germany

[73] Assignee: Patent-Treuhand-Gesellschaft F. Elektrische Gluehlampen mbH, Munich, Fed. Rep. of Germany

[21] Appl. No.: 954,815

[22] Filed: Oct. 1, 1992

[30] Foreign Application Priority Data

Oct. 11, 1991 [DE] Fed. Rep. of Germany ... 9112690[U]

[51] Int. Cl.[5] ..... H01J 61/36; H01J 9/32; H01J 61/82

[52] U.S. Cl. ..... 313/623; 313/625; 313/624

[58] Field of Search ..... 313/623, 624, 625, 318, 313/626

[56] References Cited

U.S. PATENT DOCUMENTS

| | | | |
|---|---|---|---|
| 3,363,133 | 1/1968 | Harris et al. . | |
| 4,545,799 | 10/1985 | Rhodes et al. . | |
| 4,959,588 | 9/1990 | Vida et al. | 313/623 |

FOREIGN PATENT DOCUMENTS

| | | |
|---|---|---|
| 0034113 | 8/1981 | European Pat. Off. . |
| 0136505 | 4/1985 | European Pat. Off. . |
| 0472100 | 2/1992 | European Pat. Off. . |
| 528428 | 2/1993 | European Pat. Off. . |
| 2173092 | 10/1973 | France . |
| 60-115145 | 6/1985 | Japan . |
| 1465212 | 2/1977 | United Kingdom . |

*Primary Examiner*—Donald J. Yusko
*Assistant Examiner*—N. D. Patel
*Attorney, Agent, or Firm*—Frishauf, Holtz, Goodman & Woodward

[57] ABSTRACT

To permit operation of a high-pressure discharge lamp having a metal halide fill at temperatures higher than those acceptable by quartz glass bulbs, the discharge vessel is made of transparent ceramic, thus providing, in operation, better color rendition and higher light output. To eliminate the corrosive effects of attack by the halides on a lead-through connection, the lead-through is made of a solid rod, pin or wire of, preferably, niobium of between 0.5 to 1 mm diameter, passing through a sintered plug (10), in which the niobium lead-through is recessed into the bore from the plug, and the electrode shaft (12) is connected to the lead-through within the recess. The walls of the plugs surrounding the recess thus protect the niobium against corrosive attack, while maintaining the seal throughout its length. Thus, niobium which has a temperature coefficient of expansion close to that of the ceramic can be used. If a glass melt is also used, it is placed at the outer circumference of the plug where the operating temperature is sufficiently low so that the halides in the fill will not degrade the glass melt. To prevent evaporation of niobium during the sintering process, a protective sleeve, for example of ceramic, can be placed over the lead-through at portions where niobium might evaporate from the rod, pin or wire, and also then strengthening the niobium, which has a tendency to become brittle at sintering temperatures.

20 Claims, 2 Drawing Sheets

HIGH-PRESSURE DISCHARGE LAMP WITH CERAMIC DISCHARGE VESSEL

Reference to related patent, the disclosure of which is hereby incorporated by reference:

U.S. Pat. No. 4,545,799, Rhodes et al.

Reference to related disclosures:

British Patent 1,465,212, Rigden

European Patent 0 034 113, Kerekes.

FIELD OF THE INVENTION

The present invention relates to discharge lamps, and more particularly to a high-pressure discharge lamp which has a metal halide fill and which, in order to be able to operate at a higher temperature than possible with glass discharge vessels, uses a ceramic discharge vessel to thus improve the color rendition of the light output.

BACKGROUND

Metal halide discharge lamps usually have a discharge vessel or discharge bulb made of quartz glass. In order to improve the color rendition, higher operating temperatures are necessary than the glass vessels can safely accept, and discharge vessels made of ceramic material have been proposed. Typical operating power ratings are between 100 to 250 W. The discharge vessels are generally elongated, for example cylindrical, and closed off at their open ends with plugs. The plugs have a central bore or opening through which current supply leads pass. The electrodes are then connected to the current supply leads at the inside of the vessel, and external supply connections are made at the outside. The discharge vessel may be surrounded by an outer envelope, through which the external current connections are carried, for example via molybdenum foils embedded in pinch seals.

Ceramic discharge vessels are known, and technology to close off the discharge vessels and seal plugs therein likewise is known. Sodium high-pressure discharge lamps typically have such structures. Usually, tubular or rod or pin-like through-connections pass through the plugs. The through-connections are, generally, made of niobium, see British Patent 1,465,212 and European 0 034 113. The connections, that is, the tubes or pins or rods, are melt-sealed in the ceramic plugs by a glass melt or glass solder, or by a melt ceramic technology.

Unfortunately, melt connections known and used in sodium high-pressure discharge lamps cannot be used in metal halide discharge lamps. The lifetime of such lamps is substantially decreased when such melt connections are used, since the metal halide fill has the tendency to corrode the melt ceramic used as a seal as well as the niobium lead-through.

The referenced U.S. Pat. No. 4,545,799, Rhodes et al, describes a sodium high-pressure lamp which uses a niobium tube as a lead-through. The niobium lead-through is directly sintered into the ceramic discharge vessel without melt ceramic by using, originally, a "green" $Al_2O_3$ ceramic. This is possible since both materials, that is the aluminum oxide ceramic and the niobium, have roughly the same thermal coefficient of expansion (TCE), in the order of $8\times10^{-6}$/K. This improves the lifetime. The problem of corrosion of the niobium when a metal halide fill is used, however, remains so that this technology cannot be transferred to metal halide discharge lamps.

THE INVENTION

It is an object to provide a high-pressure discharge lamp having a ceramic vessel, with improved color rendition and light output, utilizing a metal halide fill, and which retains the high light output and good color rendition over an acceptably long lifetime.

Briefly, a rod or pin forming the lead-through is gas-tightly directly sintered into a ceramic closing plug for the discharge vessel in such a manner that the rod or pin is recessed into a bore at least at the discharge side of the plug. Surprisingly, it has been found that metals suitable as lead-throughs, and having approximately the same TCE as the surrounding plug material, can be directly sintered to the plug and the corrosion effect of the metal halide fill is inhibited or entirely eliminated by forming a recess around the pin or rod at the side where it extends into the discharge vessel. This, effectively, protects the pin in the opening or bore of the plug by the surrounding wall of the bore. The diameter of the pin or plug is, preferably, between 0.5 to 1 mm.

It is not possible to transfer the technology known in connection with sodium high-pressure discharge lamps to ceramic lamps with metal halide fills since, at the same time, two different problems have to be solved at once:

The halides of the metal halide fill attack the melt ceramic and the halides of the metal halide fill attack the lead-through.

The solution to the second problem is particularly difficult because there are only very few metals which have a thermal coefficient of expansion which roughly matches that of the ceramic. Two such metals are niobium and tantalum. Unfortunately, these two metals are particularly readily corroded by the halides and can only be used when they are suitably protected against attack by the halides.

This protection is obtained by making the diameter of the pins or rods between 0.5 to 1 mm, sintering the pin or rod directly into the plug, that is, without using a melt ceramic technology, and at the same time being careful that the pin or rod is somewhat recessed at the discharge side in order to protect the surface of the pin or rod by the surrounding wall of the plug, that is, the wall surrounding the bore. Only the combination of all three characteristics ensures the desired success.

Direct sintering of lead-throughs formed as thin pins or rods or wires has the advantage with respect to tubes that the differences in thermal expansion between the ceramic plug and the metallic lead-through can be maintained at a low or small level. This aspect is irrelevant when using melt technology, since the melt ceramic technology still ensures a tight seal if there are small differences in expansion, a few percent for example. In directly sintering, small differences in expansion already become problems and the tight seal must be obtained by other means. Thus, in sodium high-pressure lamps, it was customary to use only tubular lead-throughs when direct sintering was proposed. Any stresses due to differences in expansion can be accepted by the elasticity of the tube.

It is technically not possible to make tubes having a diameter of under 2 mm. Typical values for tubular lead-throughs are diameters of about 4 mm.

The elasticity, lacking in pins or rods, appeared to exclude solid pins or rods having similar dimensions and, thus, research was directed to finding other ways.

It was discovered that the most effective improvement could be obtained by eliminating attack of the halogens of the halide fill on the lead-through. This was obtained by recessing the end portion of the lead-through in the plug. The results, however, were still not completely satisfactory since the end facing surface at the bottom of the tube, in which the electrode shaft was attached, necessarily is too large due to the lowest limit of size based on manufacturing, and particularly economical manufacturing considerations. The lifetime of such lamps was limited to about 200 hours.

Thus, tubular lead-throughs, even if recessed, were not satisfactory.

Tests and experiments made with solid pins in connection with known melt-in technology did not yield satisfactory results due to corrosion problems at the melt-in seal. Surprisingly, even recessing these pins or rods in the bore of the feedthrough could not change the corrosion effects. On the contrary, and it is considered a paradox, if the diameter of the pin is reduced—which would be desirable as such in order to decrease the absolute value of differences in expansion, and the diameter of the lead-through pin or rod, upon such reduction reached the order of magnitude of the electrode shaft—the results were poor because when filling the melt ceramic, since it does not flow only to the discharge side end of the pin or rod but, rather, by capillary force, is sucked into the ring-shaped gap between the bore and the electrode shaft at the discharge end. This arrangement then, upon cooling and due to the mismatch between the ceramic plug, melt ceramic and electrode shaft, unavoidably resulted in cracks in the melt ceramic and, finally, in the plug itself. The electrodes, typically, are made of tungsten which has a TCE which is approximately 50% smaller than that of the ceramic. The result was a short lifetime and a high degree of early failures.

The natural lower limit for the diameter of a lead-through pin or rod is determined only by the current loading, which also determines the diameter of the electrode shaft. If the diameters are held to be very small, in the order of about 0.5 to 1 mm, the absolute value of the difference of the thermal expansion between the lead-through and the ceramic pin becomes very small. This has the decisive result that direct sintering of thin solid pins appeared to lead to success in solving the problem.

The technology of direct sintering of solid wires, pins or rods is, thus, basically different from direct sintering of tubes or pipe elements, since the diameter of these pins or rods is substantially smaller, and the stresses which arise when tubes are directly sintered do not arise at all.

Making the lead-through thin has the further advantage that its diameter can be matched readily, or at least approximately, to the diameter of the electrode shaft. Thus, the end face of the pin or rod—in contrast to that of a tube—can be optimally covered by the electrode shaft. Particularly good results were obtained when the diameter of the pin or rod is just slightly greater, by about 5–10%, than that of the electrode shaft. The electrode shaft is butt-welded to the end of the lead-through pin, rod or wire. If the difference in diameter of the pin, rod or wire and of the electrode shaft becomes too great, the absolute value of the thermal difference in expansion, with reference to the ceramic, will become too high and the lifetime of the lamp again deteriorates due to leakage. If the difference in diameters is small, and even approaches zero, which would result in an effectively complete covering of the end face of the pin, rod or wire, the wall of the plug would equally sinter on the lead-through as well as on the electrode shaft. Yet, only the lead-through has a TCE which is matched well to that of the sinter ceramic, typically being made of niobium, whereas the electrode shaft is usually completely mismatched, typically made of tungsten. As the electrode shaft cools, the ceramic would be subjected to fissures or cracks.

The sintering process must be carefully controlled to prevent sintering of plug material on the electrode shaft. This can readily be obtained by suitable size of the grains of the sinter material. The plug ceramic, before sintering, is a green ceramic. The two pin or rod-like elements, namely the lead-through and the electrode shaft, have to be in precise axial alignment. While making the lead-through and the electrode shaft of the same diameter would be possible, it is preferred to have a small difference. Making the lead-through just slightly thicker limits the possibility of attack of the halide fill on the lead-through to a very small ring-shaped zone at the end surface at the discharge side of the lead-through pin. The integrity of the seal of the sintering remains.

The referenced Rhodes et al U. S. Pat. No. 4,545,799 describes direct sintering, and the process to obtain the lamp in accordance with the present invention can be, in essence, the process described in this referenced patent. The green plug is first supplied with the lead-through system, then sintered, so that the lead-through plug shrinks on the niobium pin. Temperatures of about 1850° C. at a pressure of $10^{-4}$ mbar are used.

When carrying out this process, it has been found that, highly undesirably, niobium has the tendency to evaporate. Niobium, at the sinter conditions, has a noticeable vapor pressure. Consequently, the outside of the discharge vessel, during the sintering process, may become gray, thus detracting from overall light output of the lamp.

To prevent vaporization of the niobium of the pin, it is desirable to surround the projecting portion of the niobium pin with a protective jacket, at least during sintering. It has been found suitable to use a ceramic or similar sleeve which surrounds the outer portion of the niobium pin. This sleeve can be removed at a later time, or remain in place, and, if remaining, can be secured in a recess of the end plug. It can, at the same time, form a support for the lead-through which, during sintering, becomes somewhat brittle. This support eliminates the danger of breakage when the outer electrical connection is secured to the lead-through.

In accordance with a preferred feature of the invention, the lead-through pin, rod or wire is secured in the plug in such a manner that both ends of the plug, where the lead-through extends therethrough, are formed with recesses or countersinks. A connecting wire extends from the niobium pin, rod or wire to an outer connection within the outer bulb. This connecting wire, which preferably is made of tungsten, thus of a material which is resistant to becoming brittle upon sintering, is butt-welded to the lead-through, similar to a connection of the electrode shaft. Both butt welds are placed within the recess, i.e. the outline of the plug. The bore within the plug has a generally constant diameter, matched to the diameter of the niobium pin. This provides for optimum shielding of the niobium pin, rod or wire, from attack by the halides at the interior of the discharge vessel, as well as with respect to emission of niobium into the outer volume which may lead to degradation of the light output from the lamp by externally coating the discharge vessel.

In accordance with a preferred feature of the invention, the length of the niobium pin, wire or rod within the plug is about 80% of the length of the ceramic plug, so that the sealing path is as long as possible, whereas the advantages of the recessing, that is protection against corrosion and niobium evaporation on the outer envelope, can become fully effective. Thus, 10%, i.e. the length of the recesses at the two ends in the ceramic plug should be taken up by a portion of the electrode shaft and connecting wire, respectively.

DRAWINGS

DETAILED DESCRIPTION

Figure 1:
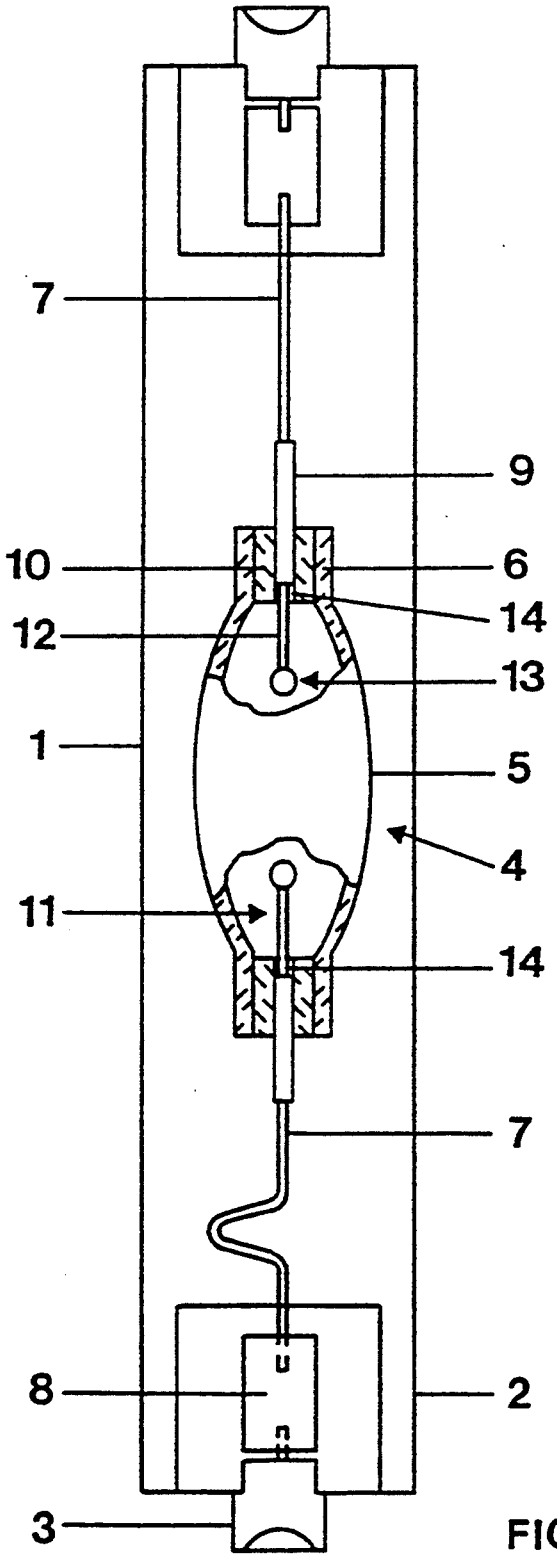
FIG. 1 is a highly schematic longitudinal view, partly in section, illustrating a metal halide lamp using a ceramic vessel.

For purposes of illustration, a metal halide lamp having a power rating of 150 W has been selected. It has a longitudinal lamp axis, and a cylindrical outer envelope 1 made of quartz glass. The envelope 1 has two pinch seals 2 at the end, and is supplied with standardized bases 3. The axially located discharge vessel 4 is made of a $Al_2O_3$ ceramic. The center portion 5 is barrel shaped or ellipsoid and bulged outwardly. The end portions 6 of the discharge vessel 4 are generally cylindrical. Two current connection leads 7, connected to the bases 3 via molybdenum foils 8, pinch-sealed in the pinch seals 2 of the outer envelope 1 connect to lead-throughs 9, fitted into end plugs 10. The connections 7 are typically of molybdenum, and welded to the lead-throughs 9.

The lead-through elements 9 solid; they are pin, rod or wire-shaped and made of niobium. They define, interiorly of the vessel 5, a discharge side and, at the opposite side, they define an outer side. At the discharge side, each lead-through 9 of niobium is secured to electrodes 11 which have an electrode shaft 12 made of tungsten and a generally spherically end 13. The vessel 4 retains a fill. The fill has an inert ignition gas, for example argon, and mercury as well as metal halide additives.

In accordance with a feature of the invention, the niobium lead-through is recessed in the bore 14 in the end plug 10. The electrode shaft 12 extends into the bore 14 of the plug 10, since the pin 9 is recessed at the discharge side. The pin 9 extends beyond the outer end, that is, the outer side of the plug, and is directly connected to the connection lead 7.

Figure 2:
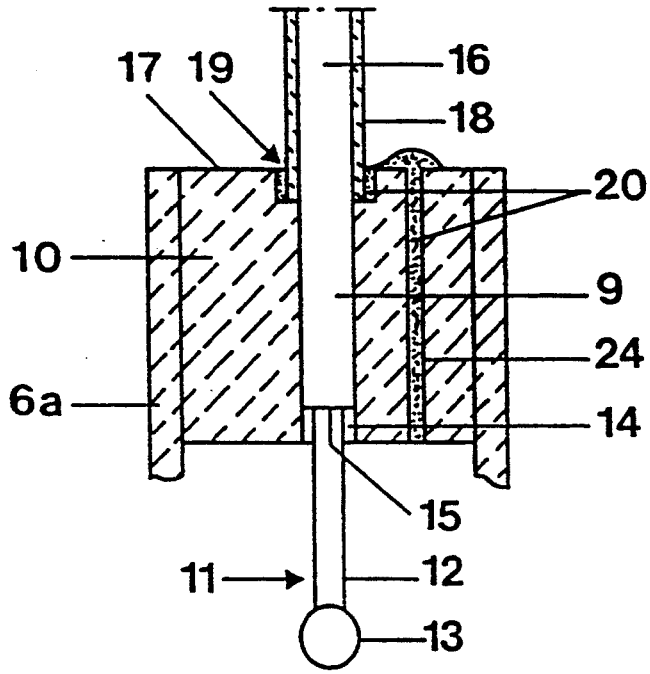
FIG. 2 is a fragmentary view to an enlarged scale, illustrating another embodiment of a lead-through arrangement.

FIG. 2 illustrates a detail of the pump end **6*a* of the discharge vessel, and another embodiment of the lead-through arrangement. The discharge vessel has a wall thickness of 1.2 mm at its end portions. The cylindrical plug 10, made of $Al_2O_3$ ceramic, is fitted into the end 6*a* of the discharge vessel. It has an outer diameter of 3.3 mm, and an axial length of 6 mm. A niobium pin 9 having a length of 12 mm is fitted into the axial bore 14. The niobium pin 9 has a diameter of 0.6 mm and is directly sintered therein. The electrode shaft 12, which has a diameter of 0.55 mm, is butt-welded to the niobium pin 9**.

The drawing is not to scale, and illustrates the arrangement.

The outer region 16 of the niobium pin is tightly surrounded by a sleeve 18. The bore 14 is widened at the outer end 17 of the plug 10. Sleeve 18 is fitted into this widened region 19 and retained therein by a glass melt 20. The sleeve 18 prevents evaporation of niobium during sintering thus externally blackening or greying the discharge vessel 4, and further stabilizes the niobium pin 9, 16, which becomes brittle during sintering.

An evacuation and fill bore 24 extends through the plug 10, axially parallel to the lamp, but laterally offset with respect thereto. It is sealed with a high melt sealing ceramic 20 when the evacuation and filling processes have been finished. Attaching the sleeve 1 and sealing the fill bore 24 can be carried out in a single manufacturing step. To reduce the melt ceramics in the fill bore 24, a filling rod of $Al_2O_3$ ceramic can be fitted into the fill bore 24.

Figure 3:
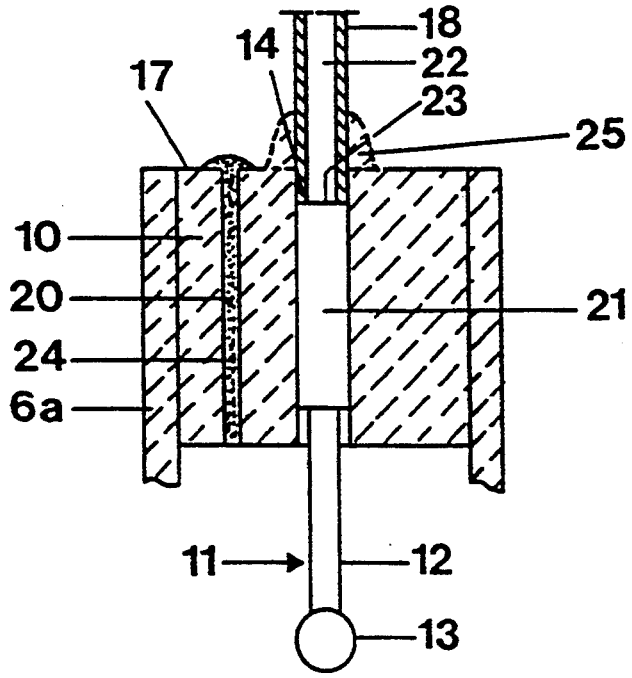
FIG. 3 is a view similar to FIG. 2 illustrating yet another embodiment.

FIG. 3 illustrates a particularly preferred embodiment of the invention. The difference with respect to FIG. 2 is this: The niobium pin 21 has a length of 5 mm, and a diameter of 0.8 mm. The pin 21 is recessed or countersunk at both the discharge side and the outer side, so that it would be possible to eliminate a sleeve 18 entirely. The electrode shaft 12 is made of tungsten wire and has a diameter of 0.75 mm, and a length of 7 mm. It extends into the bore 14 for a distance of 0.5 mm. A tungsten connecting wire 22 is butt-welded to the pin 21 at the outer side 17 of the plug 20. The connecting wire 22 has a wire diameter of 0.75 mm, similar to the electrode shaft, and a length of 11 mm. The seam 23 between the connecting wire 22 and the lead-through 21 is recessed in the actual bore 14 of the plug 10 by a distance of about 0.5 mm. Contact between the tungsten wire 22 and the glass melt 20 in the fill bore 24 should, preferably, be prevented since, otherwise, it might lead to cracks in the ceramic. A sleeve 18' of niobium or ceramic surrounds the tungsten wire 22. In contrast to tungsten or molybdenum, both niobium and ceramic have a TCE which is matched to the sealing melt ceramic 20. A collar 25 formed on the plug 10 preferably surrounds the tungsten wire 22 directly, or, as shown, the sleeve 18' which then preferably is ceramic. The collar is not strictly necessary and, therefore, has been outlined by broken lines.

The sintering technology as described can be used for both ends of the discharge vessel.

Lamp assembly

First, a complete electrode system comprising an electrode, lead-through and end plug is directly sintered into a first end of the discharge vessel, without using any melt glass or melt ceramic. The discharge vessel is then placed in a glove box, evacuated through the second, still open end, and supplied with a fill. A plug, made as a subassembly with the fitted electrode system already sintered into the plug, is then fitted into the second end, and the plug is sealed with respect to the discharge vessel by a glass melt or a melt ceramic.

Considered at first blush, the advantage of the melt connection without using glass melt in the lead-through system has been lost, since the glass melt can be attacked by the halides. However, it must be realized that the reactivity of the glass melt with respect to the halides is highly temperature-dependent, and based on an exponential law. The actual lead-through, in operation, has a substantially higher temperature than the wall portions. Thus, the operating temperatures at the lead-through are typically 1100° C., whereas in the vicinity of the wall of the discharge vessel, the temperature is about 900° C. Thus, the glass melt seal between the plug and the wall is subjected to a substantially lower stress, so that the lifetime of the lamp, with respect to a complete glass melt-free seal, is hardly affected.

Alternatively, the discharge vessel may be formed with an evacuation and fill opening, either in a side wall of the discharge vessel or extending through the plug 10, as illustrated in FIGS. 2 and 3. If the plugs of FIGS. 2 and 3 are used, the ends of the discharge vessel are fitted with the electrode—plug subassembly, and both ends are sealed simultaneously by direct sintering. The additional bore 24 is then used to evacuate the discharge vessel and supply the fill thereto, and is then sealed with a high melting ceramic. This can be done by placing a solid melt ceramic mass on the bore, locally heating the bore and the mass, which thus gas-tightly seals the bore 24. Precisely targeted heating of the additional bore in a hole in a side wall can be obtained by localized heating generated by a laser beam which is suitably spread by special beam spreading optics.

The use of a sleeve 18 (FIGS. 2 and 3) prevents direct contact between the tungsten pin,be it the electrode shaft 12 or the external connection 22, and glass melt material. Melting-in or connecting a sleeve and sealing the fill bore can be carried out in a single operating step.

Various changes and modifications may be made, and any features described herein may be used with any of the others, within the scope of the inventive concept.

I claim:

1. High-pressure discharge lamp comprising a ceramic discharge vessel (4) having at least one open end (6, 6');

a ceramic plug (10) formed with an axial bore (14) therethrough, closing off the open end of the vessel and defining, respectively, a discharge side at the interior of the vessel and an outer side opposite said discharge side;

a lead-through passing through said axial bore (14), said lead-through comprising a solid rod or pin or wire (9, 21) essentially consisting of a metal which has a temperature coefficient of expansion at least approximately similar to the temperature coefficient of expansion of the ceramic material of the ceramic plug (10);

an electrode (13) having an electrode shaft (12), said electrode shaft extending towards said lead-through rod, pin or wire and being electrically and mechanically secured to one end of said lead-through rod, pin or wire at the discharge side of the plug; and current connection means (7, 22) connected to the other end of said lead-through rod, pin or wire, and wherein the rod, pin or wire (9, 21) is gas-tightly sintered into the bore (14) of the ceramic plug (10, 10') and the rod, pin or wire (9, 21) is recessed into the bore (14) at least at the discharge side of the plug.

2. The lamp of claim 1, wherein the material of the lead-through rod, pin or wire (9, 21) comprises niobium or tantalum.

3. The lamp of claim 1, wherein said rod, pin or wire (9) has a portion which extends beyond the outer side (17) of the plug (10); and a sleeve (18) is provided, surrounding said extending portion.

4. The lamp of claim 3, wherein said sleeve (18) comprises ceramic material.

5. The lamp of claim 3, wherein the diameter of the rod, pin or wire (9, 21) is between about 0.5 to 1 mm.

6. The lamp of claim 1, wherein the diameter of said rod, pin or wire (9, 21) is slightly greater than the diameter of the shaft (12) of the electrode.

7. The lamp of claim 6, wherein the diameter of the rod, pin or wire (9, 21) is larger by about 5–10% than the diameter of the electrode shaft (12).

8. The lamp of claim 1, wherein the length of the portion of the electrode shaft (12) which is recessed into the bore (14) within the plug is about 10% of the axial length of said plug.

9. The lamp of claim 1, wherein the diameter of the rod, pin or wire (9, 21) is between about 0.5 to 1 mm.

10. The lamp of claim 1, wherein said electrode shaft (12) is butt-welded to the lead-through rod, pin or wire (9, 21).

11. High-pressure discharge lamp comprising a ceramic discharge vessel (4) having at least one open end (6, 6');

a ceramic plug (10) formed with an axial bore (14) therethrough, closing off the open end of the vessel and defining, respectively, a discharge side at the interior of the vessel and an outer side opposite said discharge side;

a lead-through passing through said axial bore (14), said lead-through comprising a solid rod or pin or wire (9, 21) essentially consisting of a metal which has a temperature coefficient of expansion at least approximately similar to the temperature coefficient of expansion of the ceramic material of the ceramic plug (10);

an electrode (13) having an electrode shaft (12), said electrode shaft extending towards said lead-through rod, pin or wire and being electrically and mechanically secured to one end of said lead-through rod, pin or wire at the discharge side of the plug; and current connection means (7, 22) connected to the other end of said lead-through rod, pin or wire, and wherein the rod, pin or wire (9, 21) is gas-tightly sintered into the bore (14) of the ceramic plug (10, 10') and the rod, pin or wire (9, 21) is recessed into the bore (14) at least at the discharge side of the plug; and wherein said rod, pin or wire (21) is fitted into the bore (14) recessed from both the discharge side as well as the outer side of the plug (10).

12. The lamp of claim 11, wherein a connecting element (22) comprising a metal of high melting point is connected to the rod, pin or wire (21) and forms at least part of said current connection means (7), and wherein said high melting point is above the sintering temperature of the ceramic plug (10).

13. The lamp of claim 11, wherein the diameter of the rod, pin or wire (9, 21) is slightly greater than the diameter of the connecting element (22).

14. The lamp of claim 13, wherein the diameter of the rod, pin or wire (9, 21) is greater by between about 5–10% than the diameter of the connecting element (22).

15. The lamp of claim 11, wherein the length of the portion of the electrode shaft (12) which is recessed into the bore (14) within the plug is about 10% of the axial length of said plug.

16. The lamp of claim 12, wherein the connecting element (22) is butt-welded to the rod, pin or wire (9, 21).

17. The lamp of claim 11, wherein the diameter of the rod, pin or wire (9, 21) is between about 0.5 to 1 min.

18. The lamp of claim 11, wherein the diameter of the rod, pin or wire (9, 21) is between about 0.5 to 1 min.

19. The lamp of claim 11, wherein said rod pin or wire (9) has a portion which extends beyond the outer side (17) of the plug (10); and a sleeve (18) is provided, surrounding said extending portion.

20. High-pressure discharge lamp comprising a ceramic discharge vessel (4) having at least one open end (6, 6');

a ceramic plug (10) formed with an axial bore (14) therethrough, closing off the open end of the vessel and defining, respectively, a discharge side at the interior of the vessel and an outer side opposite said discharge side;

a lead-through passing through said axial bore (14), said lead-through comprising a solid rod or pin or wire (9, 21) essentially consisting of a metal which has a temperature coefficient of expansion at least approximately similar to the temperature coefficient of expansion of the ceramic material of the ceramic plug (10);

an electrode (13) having an electrode shaft (12), said electrode shaft extending towards said lead-through rod, pin or wire and being electrically and mechanically secured to one end of said lead-through rod, pin or wire at the discharge side of the plug; and current connection means (7, 22) connected to the other end of said lead-through rod, pin or wire, and wherein the rod, pin or wire (9, 21) is gas-tightly sintered into the bore (14) of the ceramic plug (10, 10') and the rod, pin or wire (9, 21) is recessed into the bore (14) at least at the discharge side of the plug;

said rod, pin or wire (9) has a portion which extends beyond the outer side (17) of the plug (10); and a sleeve (18) is provided, surrounding said extending portion.

* * * * *